US005515093A

United States Patent [19]

Haruta et al.

[11] Patent Number: 5,515,093

[45] Date of Patent: May 7, 1996

[54] INK JET PRINTING METHOD AND PRINT MEDIUM FOR USE IN THE METHOD

[75] Inventors: Masahiro Haruta, Tokyo; Shoji Koike, Yokohama; Koromo Shirota, Inagi; Aya Takaide, Yokohama; Tomoya Yamamoto; Mariko Suzuki, both of Kawasaki, all of Japan

[73] Assignee: Canon Kabushiki Kaisha, Tokyo, Japan

[21] Appl. No.: 263,678

[22] Filed: Jun. 22, 1994

[30] Foreign Application Priority Data

Jun. 25, 1993 [JP] Japan ..... 5-155306
Jun. 25, 1993 [JP] Japan ..... 5-155317

[51] Int. Cl.[6] ..... G01D 15/16

[52] U.S. Cl. ..... 347/101; 347/105

[58] Field of Search ..... 347/101, 106, 347/103, 105

[56] References Cited

U.S. PATENT DOCUMENTS

| | | | |
|---|---|---|---|
| 4,702,742 | 10/1987 | Iwata et al. | 8/495 |
| 4,725,849 | 2/1988 | Koike et al. | 346/1.1 |
| 4,849,770 | 7/1989 | Koike et al. | 346/1.1 |
| 4,877,680 | 10/1989 | Sakaki et al. | 428/332 |
| 4,969,951 | 11/1990 | Koike et al. | 106/22 |
| 5,101,218 | 3/1992 | Sakaki et al. | 346/1.1 |
| 5,250,121 | 10/1993 | Yamamoto et al. | 106/22 |

FOREIGN PATENT DOCUMENTS

| | | | |
|---|---|---|---|
| 0387893A1 | 9/1990 | European Pat. Off. . | |
| 3640359A1 | 5/1987 | Germany . | |
| 61-231285 | 10/1986 | Japan | 347/101 |
| 63-6183 | 1/1988 | Japan . | |
| 63-085188 | 4/1988 | Japan | 347/101 |
| 2-68372 | 3/1990 | Japan . | |

OTHER PUBLICATIONS

Derwent Accession No. 88–4076, Abstract of JP–A–62–268682, Nov. 21, 1987.

Derwent Accession No. 92–013744, Abstract of JP–4–341885, Nov. 27, 1992.

Derwent Accession No. 90–119123, Abstract of JP–A–2–68372, Mar. 7, 1990.

*Primary Examiner*—Benjamin R. Fuller
*Assistant Examiner*—Valerie Ann Lund
*Attorney, Agent, or Firm*—Fitzpatrick, Cella, Harper & Scinto

[57] ABSTRACT

An ink jet printing method for effecting printing on a print medium such as a sheet of cloth by applying a jet of an ink to the print medium. The print medium is formed by preparing a sheet of cloth containing a cationic substance, preparing a backing sheet having a layer of an adhesive agent, and bonding the sheet of cloth to the adhesive surface of the backing sheet. After the jet of ink is applied to the print medium, the sheet of cloth is peeled off from the backing sheet and the freed sheet of cloth is rinsed with rinsing water containing a cation blocking agent, followed by drying.

26 Claims, 4 Drawing Sheets

INK JET PRINTING METHOD AND PRINT MEDIUM FOR USE IN THE METHOD

BACKGROUND OF THE INVENTION

1. Field of the Invention

The present invention generally relates to printing on a sheet of cloth and, more particularly, to an ink jet printing method for printing information or a pattern on a sheet of cloth using an ink jet printer, and also to a print medium suitable for use in carrying out the printing method.

2. Description of the Related Art

In recent years, studies have been made with respect to printing methods for ink jet printing that are more suitable for small-lot production of a variety of types of products other than ordinary printing methods such as screen printing and roller printing. Ordinary ink jet printers used in offices or by individuals are designed to print information on sheets of paper or OHP sheets, and cannot be directly used for printing on a variety of types of print mediums such as cloth or the like. Namely, there are a lot of problems to be solved with respect to using the known ink jet printing techniques for printing on media such as sheets of cloth.

In particular, ink jet printing on various types of cloth require use of different types of inks because the optimum structure and type of the colorant varies according to the kind of the cloth. Inks which are used in ordinary office-use or personal ink jet printers are designed to be suitable for printing on paper sheets or OHP transparency sheets. Such inks can be used only for limited types of cloths or pose problems such as reduction in the color density after printing or contamination of the non-printed area of the cloth in the course of water rinsing, which is conducted after printing. Another problem encountered in printing on cloth is that feeding and conveyance of a sheet of cloth in a printing machine is difficult because of a lack of stiffness.

Various proposals have been made to overcome these problems. For instance, Japanese Patent Laid-Open No. 63-6183 discloses a method in which a sheet of cloth is temporarily adhered on a flat carrier plate which is neither expandable nor shrinkable and which has an adhesive layer, so that the printing is effected on the sheet of cloth while the latter is held by the carrier plate. Japanese Patent Laid-Open No. 2-68372 discloses a method in which a sheet of cloth is adhered to a sheet having an adhesive layer which is formed of a mixture of an adhesive agent and an anti-migration agent, so that the printing is effected on the sheet of cloth stiffened and carried by the carrier sheet. These proposed methods are intended to improve feed and conveyance of the cloth or to suppress irregular bleeding of the ink used in the printing. These proposed methods, however, are still unsatisfactory and further improvements are required.

SUMMARY OF THE INVENTION

Accordingly, it is an object of the present invention to provide an ink jet printing method which can effect printing on a sheet of cloth, regardless of the type of the cloth and without requiring change of ink according to the type of the cloth, and which can be applied to ink jet printers for office or personal use, so as to provide practical printed products which exhibit high coloring density and which are free of problems such as contamination of non-printed areas which otherwise may be caused during water-rinsing conducted after the printing, as well as a print medium suitable for use in the ink jet printing method.

To this end, according to one aspect of the present invention, there is provided an ink jet printing method for effecting printing on a print medium by applying droplets of an ink to said print medium, said method comprising the steps of: providing said print medium comprising a backing sheet coated with an adhesive agent, and a sheet of cloth containing a cationic substance, said cloth sheet being provided on said backing sheet; applying said ink to said print medium; rinsing said print medium with a rinsing liquid containing a cation blocking agent; peeling said sheet of cloth from said backing sheet of said print medium after rinsing; and drying said sheet of cloth.

The invention also provides an ink jet printing method for effecting printing on a print medium by applying droplets of an ink to said print medium, said method comprising the steps of: providing said print medium comprising a backing sheet coated with an adhesive agent, and a sheet of cloth containing a cationic substance, said cloth sheet being provided on said backing sheet; applying said ink to said print medium; rinsing said print medium with a rinsing liquid containing a cation blocking agent; drying the rinsed print medium; and peeling said sheet of cloth from said backing sheet.

The invention also provides an ink jet printing method for effecting printing on a print medium by applying droplets of an ink to said print medium, said method comprising the steps of: providing said print medium comprising a backing sheet coated with an adhesive agent, and a sheet of cloth containing a cationic substance, said cloth sheet being provided on said backing sheet; applying said ink to said print medium; peeling said sheet cloth from said backing sheet of the print medium; rinsing said sheet of cloth with a rinsing liquid containing a cation blocking agent; and drying the rinsed sheet of cloth.

In another aspect of the present invention, there is provided a print medium comprising: a backing sheet having an adhesive agent; and a sheet of cloth containing a cationic substance provided on said backing sheet.

The invention also provides a print medium comprising: a backing sheet having an adhesive agent and a cation blocking agent; and a sheet of cloth containing a cationic substance provided on said backing sheet.

The invention also provides an ink jet printing method for effecting printing on a print medium by applying droplets of ink to said print medium, comprising the steps of: providing said print medium comprising a backing sheet having an adhesive agent and a cationic blocking agent, and a sheet of cloth containing a cationic substance, said cloth sheet being provided on said backing sheet; applying said ink to said print medium; rinsing said print medium with a liquid; peeling said sheet of cloth from said backing sheet of said print medium; and drying said sheet of cloth.

The invention also provides an apparatus suitable for use in carrying out the ink jet printing method.

The above and other objects, features and advantages of the present invention will become clear from the following description of the preferred embodiments when the same is read in conjunction with the accompanying drawings.

DETAILED DESCRIPTION OF THE INVENTION

Figure 1:
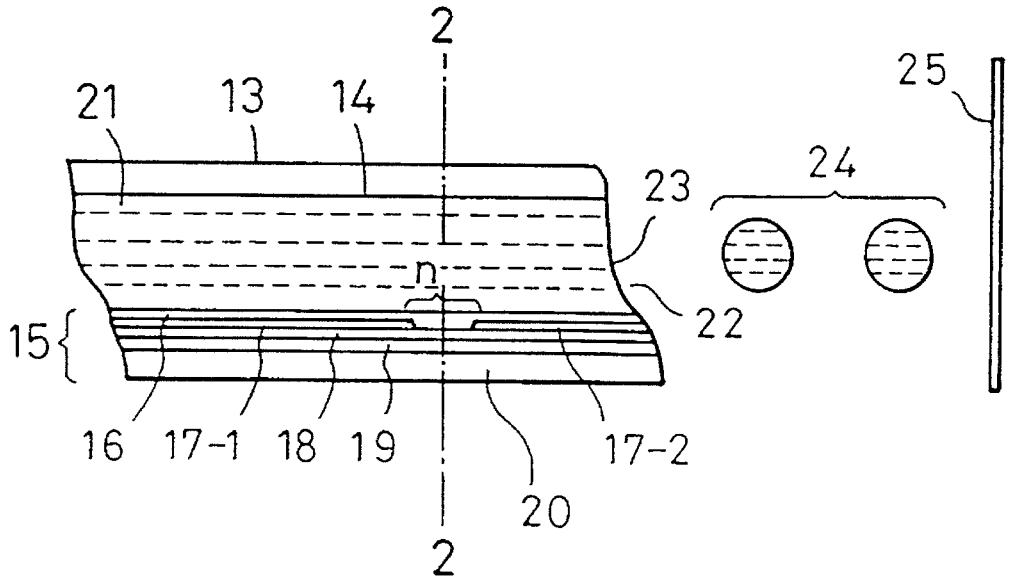
FIG. 1 is a vertical sectional view of a head portion of an ink jet printing apparatus, as indicated by the line 2—2 in FIG. 1.

One of the major features of the first aspect of the present invention resides in that a cationic substance is contained in the cloth so that printing can be conducted on a variety types of cloth by using an ink which is ordinarily used in commercially available ink jet printers. Another feature resides in that a backing member having an adhesive layer is bonded to the back side of the cloth so as to improve feed and conveyance of the cloth in a printer. Still another feature resides in that, in order to prevent contamination of non-printed areas in the course of water rinsing conducted after the printing, the rinsing is carried out by using water containing a cation blocking agent.

There is no restriction in the type of the cloth used in the ink jet printing method of the present invention. Thus, cloths of cotton, silk, nylon, rayon, acetate and polyester, as well as cloths of mixtures of these materials, can be used as the printing medium. These cloths, however, essentially contain a cationic substance.

The cationic substance is contained in the cloth before the latter is bonded to the backing sheet. One of the following methods (1) to (3) can be used for making the cationic substance contained in the cloth:

(1) To effect an addition reaction of a reactive quarternary amine compound with fibers of the cloth;

(2) To apply cationic inorganic particles with a binder (together with a cross-linking agent if needed);

(3) To apply an anionic dyeable polymer (together with cross-linking agent if needed).

Examples of the reactive quarternary amine compound are shown below.

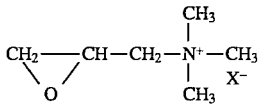

(1)

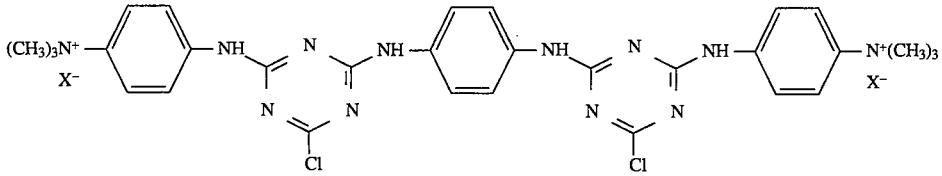

(2)

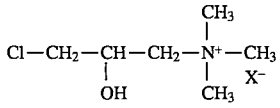

(3)

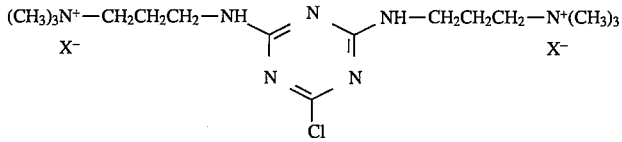

(4)

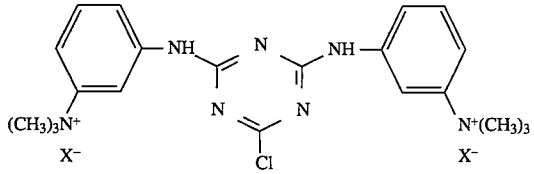

(5)

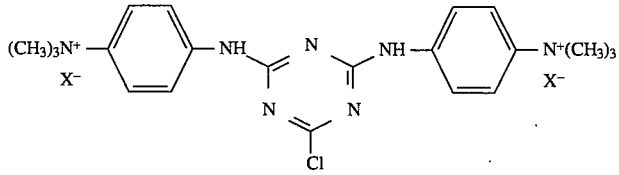

(6)

-continued

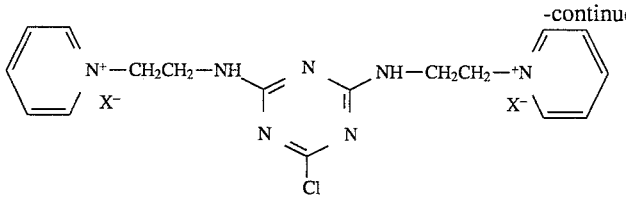

(7)

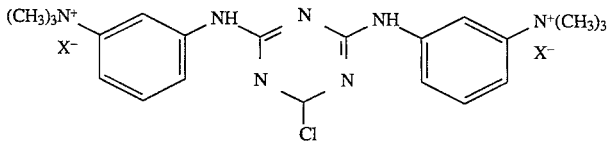

(8)

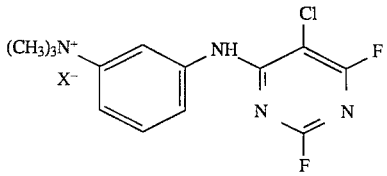

(9)

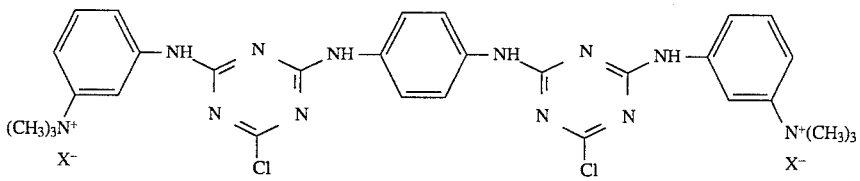

(10)

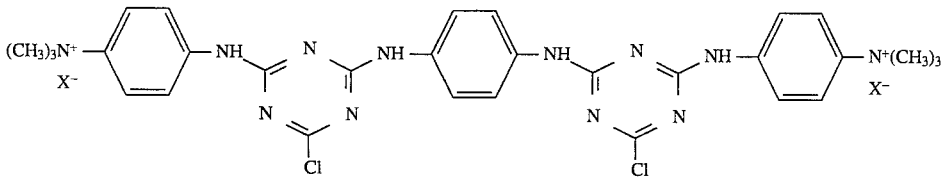

(11)

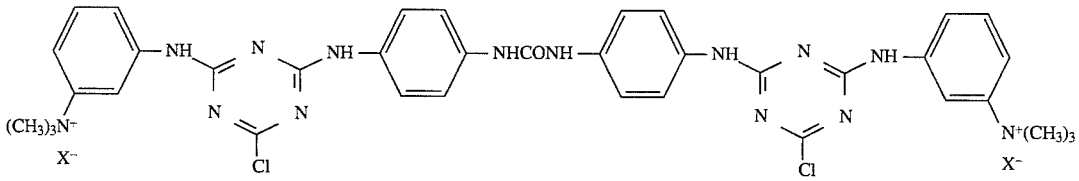

(12)

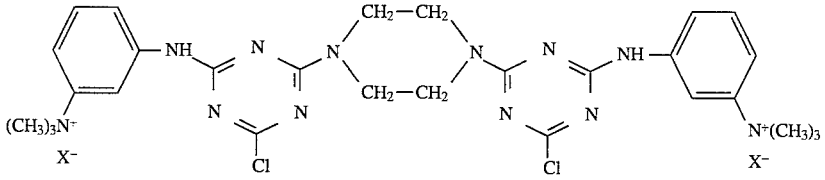

(13)

In each formula, X represents a halogen atom such as Cl, Br or the like.

An example of the cationic inorganic particles is alumina sol (particle size 5 mμto 200 mμ), such as alumina sol 100, alumina sol 200 and alumina sol 520 produced by Nissan Chemical Industries Limited.

Examples of the binder used together with the cationic inorganic particle are gum arabic, casein, glue, soybean protein, urea resin, melamine resin, polyallylamide, polyamide, polyethyleneimine, sodium polyacrylate, polyvinyl alcohol, gelatin, starch, sodium alginate, polyvinyl pyrrolidone, keratin, carboxymethylcellulose, methylcellulose, styrene-butadiene latex, styrene-maleic anhydride copolymer, and so forth.

Examples of the anionic dyeable polymer are gum arabic, casein, glue, soybean protein, urea resin, melamine resin, polyacrylamide, polyamide resin, polyurethane, polyethyleneimine and polymers containing quaternary amino groups.

Examples of the cross-linking agent are bifunctional epoxy compounds, bis-acrylamide, ethylene dimethylolurea, propylene dimethylolurea, dihydroxyethylene dimethylolurea, methylated dimethoxyethylene dimethylolurea, and so forth.

The cationic substance is provided in the cloth as a solution containing the above-mentioned compound or compounds. It is applied to the cloth or the cloth is immersed in such a solution followed by a heat-curing, water rinsing and drying. The amount of the cationic substance added to the cloth varies according to the kind of the cloth, but preferably ranges between 0.01 to 30 wt % based on the weight of the cloth.

In order to prevent bleeding on the cloth surface while improving absorption of the ink, it is possible to apply to the cloth or impregnate the cloth with a water-soluble salt, a water-soluble resin or a water-repellent compound. Examples of the water-soluble salt include table salt, sodium sulfate, sodium phosphate, sodium carbonate and sodium acetate. A fluorine compound or a silicone compound can suitably be used as the water-repellent compound.

The cloth thus treated is then bonded to a blocking sheet having an adhesive layer, so as to form a print medium for use in the ink jet printing method of the present invention.

The backing material suitably used is a sheet of paper, plastic film, metal foil or a laminate of these. A paper sheet or plastic film of 30 to 300 μm thickness is used most suitably.

The adhesive agent applied to the backing sheet may be of any known substance. For instance, it is possible to use such substances which are formed by preparing an adhesive base material such as an adhesive resin formed of a polymer, e.g., polyvinyl alcohol, polyvinyl ether, polyacrylate or polyisobutylene or a copolymer thereof, natural rubber, styrene butadiene rubber or butadiene acrylonitrile rubber, and adding to such adhesive base material various viscosity-imparting materials such as polyterpene resin or its modification, natural rosin or its modification, aliphatic resin or aromatic resin.

In order to improve spinnability of these adhesive agents, it is possible to add an inorganic pigment such as talc or calcium carbonate. It is also possible to add a fluorine-containing compound for the purpose of improving peelability.

The adhesive material may be applied to the backing sheet by an ordinary coating method over the entire area of the backing sheet or in a line or dot pattern, although the invention can be best carried out when the adhesive material is applied to the entire area of the backing sheet.

The adhesion or bonding of the cloth to the backing sheet having the adhesive layer is conducted by superposing the cloth on the adhesive layer of the backing sheet and then applying pressure uniformly over the entire area of the laminate by causing the laminate to pass through a nip between a pair of rollers or by means of a press.

The ink jet printing method of the present invention is carried out using the above-described print medium.

The ink jet printing method of the present invention can be conducted with any of inks which are used in ordinary ink jet printers. Such inks may contain a reactive dye, acid dye or a direct dye, among which an acid dye provides the printed products with excellent coloring.

Printing can be conducted by feeding the print medium of the invention into a commercially available ink jet printer which performs printing in a manner known per se.

The print medium in accordance with the present invention may have sizes which are the same as ordinary cut sheets, e.g., A-4 size, so that printing is conducted in the same manner as that effected on ordinary paper sheets or OHP transparency sheets, or may be unrolled from a roll continuously so that printing is effected on a long continuous print medium.

The print medium, after the ink applying step is subjected to a heating treatment as required, followed by one of the following three processes: (1) water rinsing, drying and peeling of the medium off the backing sheet, (2) peeling the medium from the backing sheet, water rinsing and drying and (3) water rinsing, peeling the medium off from the backing sheet and drying, whereby a printed product is obtained. In any of these processes, the treatment with water is conducted by using a water containing a cation blocking agent as the rinsing water.

By using such rinsing water, it is possible to prevent contamination of white areas, i.e., contamination of non-printed areas, while suppressing bleed of the ink, thus ensuring that a clear image is formed.

Any anionic compound can be used as the cation blocking agent, among which, most preferably, is a water-soluble fluorescent brightening agent. Examples of such a water-soluble fluorescent brightening agent include an agent of the stilbene type such as C.I. fluorescent brightener 24, 84, 85, 90, 225 or 351, an agent of imidazolon type such as C.I. fluorescent brightener 48 and an agent of triazole type such as C.I. fluorescent brightener 40 or 46. Preferably, the content of the cation blocking agent in the rinsing water ranges between 0.1 and 10 g/l.

The printed product thus obtained is cut as required into pieces of a desired shape and size, and subjected to a process such as sewing, bonding, welding or the like to become a final product such as neckties or handkerchiefs.

One of the major features of the second aspect of the present invention resides in that a cationic substance is contained in the cloth so that printing can be conducted on a variety of types of cloth by using an ink which is ordinarily used in commercially available ink jet printers. Another feature resides in that a sheet of cloth which is not stiff and unstable is temporarily bonded to a backing member having an adhesive layer so as to improve feed and conveyance of the cloth in a printer. Still another feature resides in that, in order to prevent contamination of non-printed areas in the course of water rinsing conducted after the printing, a cation blocking agent is mixed in the adhesive agent.

Thus, the second aspect of the invention is different from the first aspect in that the cation blocking agent is contained in the adhesive agent. Substances used may be the same as those used in the first aspect of the invention. The amount of the cation blocking agent ranges from 0.1 $g/m^2$ to 2 $g/m^2$ to a backing member.

Thus, in the second aspect of the invention, the adhesive agent applied to the backing sheet of the print medium is prepared to contain a cation blocking agent in order to prevent contamination of a non-printed region, while suppressing blur of the image.

The print medium after printing is subjected to a heating treatment as required, followed by a process having the steps of water-rinsing, peeling off the backing sheet and drying or a process having the steps of water-rinsing, drying and peeling off the backing sheet.

The printed product thus obtained is cut as required into pieces of desired shape and size and subjected to a process such as sewing, bonding, welding or the like to become a final product such as neckties or handkerchiefs.

The print medium of the present invention having the described construction can suitably be used in a printing apparatus and method of the type in which a thermal energy corresponding to a printing signal is applied to an ink that fills an ink chamber inside a printing head so as to form ink droplets.

An example of such a printing head will be described with reference to FIGS. 1 to 3.

The printing head 13 is formed, for example, by bonding a plate of glass, ceramic or plastic having an ink passage channel 14 to a thermal head 15 which may be of a type used in thermal or heat-sensitive printing. The thermal head 15 is composed of a protective film 16 made of, for example, silicon oxide, aluminum electrodes 17-1, 17-2, heat-generating resistor layer 18 made of nickel-chromium alloy or the like material, a heat accumulating layer 19 and a substrate 20 made of a material having excellent heat dissipating characteristics such as alumina.

The ink 21 fills the channel 14 down to a discharge orifice 22 formed at the end of the channel 14 so as to form an ink meniscus 23 by a pressure P.

When an electric signal is applied between the electrodes 17-1 and 17-2, the region indicated by "n" (see FIG. 1) of the thermal head 15 instantaneously generates heat so that a bubble is produced in the portion of the ink 21 in the region "n" so as to produce a pressure which acts to project the ink meniscus 23. Consequently, the ink 21 is forced out the orifice 22 to form a droplet 24 which flies towards the print medium 25.

Figure 3:
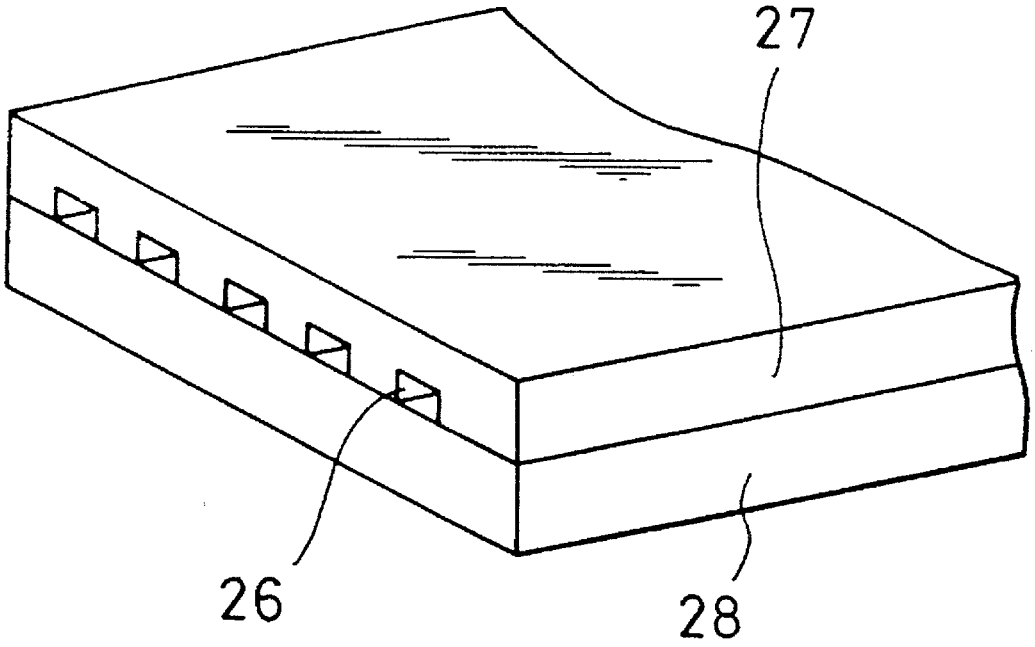
FIG. 3 is a perspective view of a multi-head assembly in which a plurality of the heads shown in FIG. 1 are assembled together.

FIG. 3 illustrates a multi-head which is composed of a multiplicity of heads of the type shown in FIG. 1 arranged side by side. The multi-head is composed of a glass sheet 27 having a multiplicity of channels 26 and a thermal head 28 to which the glass sheet 27 is bonded. The thermal head 28 may be of the type similar to that explained before in connection with FIG. 1.

Figure 2:
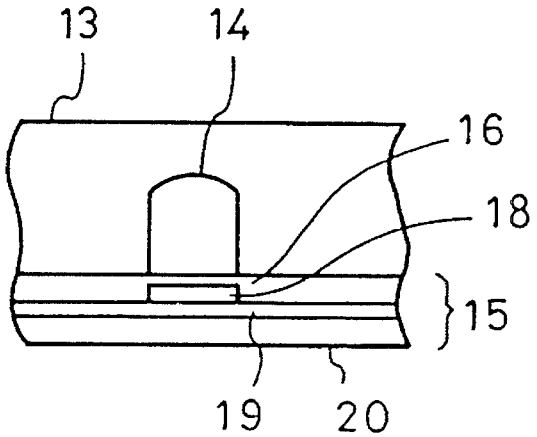
FIG. 2 is a cross-sectional view of the head portion of the ink jet printing apparatus, as indicated by the line 2—2 in FIG. 1.

In FIG. 1, the head 13 is shown in a section taken along the ink channel 14, while FIG. 2 is a cross-sectional view taken along the line 2—2 in FIG. 1.

Figure 4:
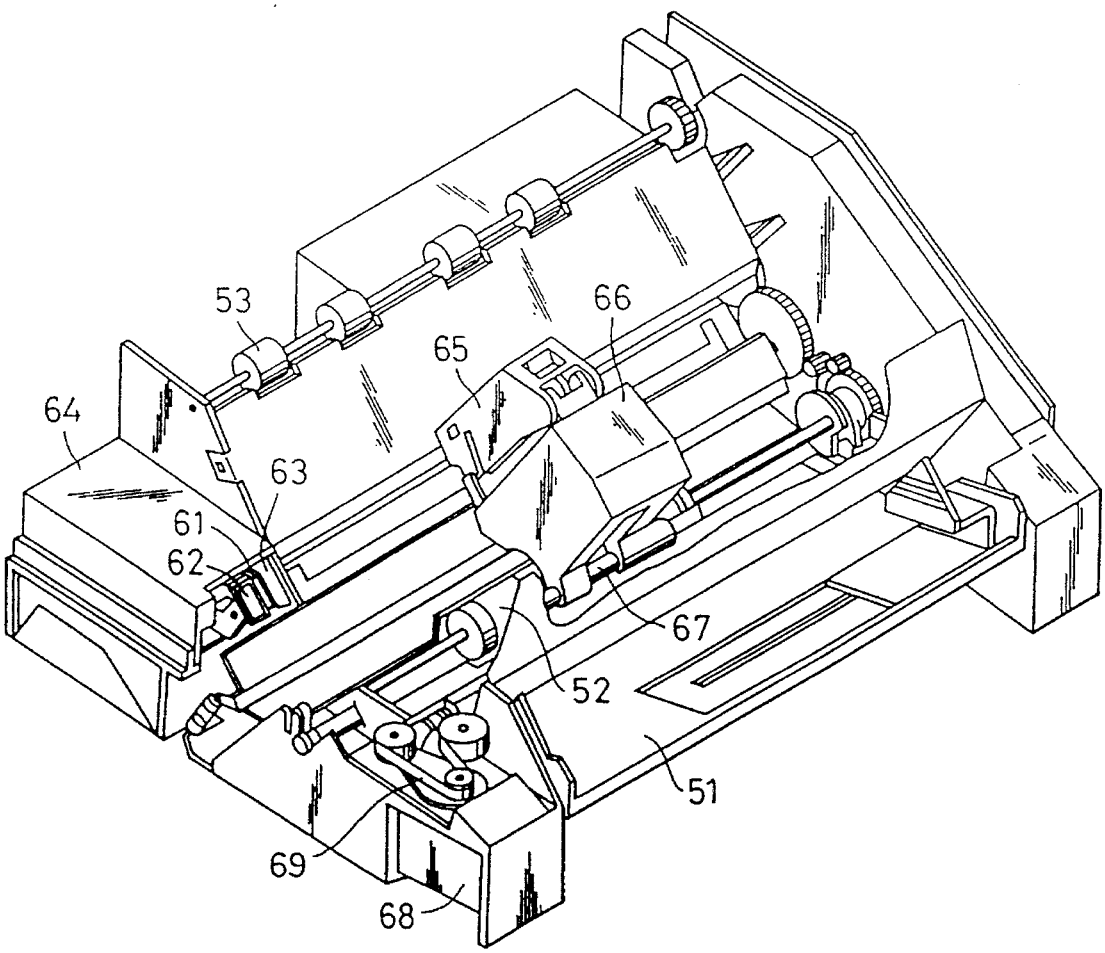
FIG. 4 is a perspective view of an ink jet printing apparatus.

FIG. 4 illustrates an example of an ink jet printing apparatus incorporating a printing head of the type described.

The ink jet printing apparatus has a cantilevered blade 61 serving as a wiping member. The blade 61 is positioned in the vicinity of a print region presented by the printing head. In the illustrated apparatus, the blade is positioned so as to project into the path of movement of the head. A cap 62 is disposed at a home position adjacent to the blade 61 so as to be movable in directions perpendicular to the path of movement of the head into and out of contact with the discharging surface of the printing head so as to cap the discharging surface. An absorption member 63 is disposed in the vicinity of the blade 61 so as to project into the path of movement of the printing head as is the case of the blade 61. The blade 61, cap 62 and the absorption member 63 in cooperation form a discharge recovery unit 64. The blade 61 and the absorption member 63 remove dust and moisture from the discharge surface of the printing head.

The printing head, denoted by 65, has a discharge surface with a plurality of discharge orifices opening therein. The printing head 65 is carried by a carriage 66 so as to be moved in one or the other direction while discharging an ink onto a print medium which faces the discharging surface of the printing head 65. The carriage 66 is slidably guided by a guide shaft 67. A belt 69 driven by a motor 68 is connected at its ends of the carriage 66 so that the carriage 66 is moved along the guide shaft 67 by the power of the motor, and so that the printing head 65 can scan an area including the printing region and a peripheral region around the printing region.

Numeral 51 denotes a cloth feeding portion having a cloth feed roller 52 which is driven by a motor not shown. The cloth as the print medium is fed to a region where the cloth faces the discharging surface of the head. As the printing proceeds, the cloth is advanced to a cloth ejection portion where a cloth ejection roller 53 is disposed.

The printing head 65 returns to the home position when, for example, it has completed the required printing operation. During the return of the printing head 65, the blade 61 of the discharge recovery unit 64 is held so as to project into the path of the printing head 65, although the cap 62 has been retracted from the path of movement of the printing head, so that the discharging surface of the printing head 65 is wiped by the blade 61. When capping of the discharging surface of the printing head 65 is necessary, the cap 62 is moved to project into the path of movement of the printing head so as to cover the discharging surface.

When the printing head moves from the home position to a print start position, the cap 62 and the blade 61 are held a positions which are the same as those in the wiping operation described above. Consequently, the discharging surface of the recording head 65 is wiped during this movement of the printing head 65.

Thus, the printing head 65 is moved to the home position when the printing is finished and when a discharge recovery operation is to be conducted. In addition, the printing head is returned intermittently at a predetermined time interval during movement between printing regions to the home position adjacent to the printing region, and the wiping operation described above is performed during this intermittent returning of the printing head to the home position.

Figure 5:
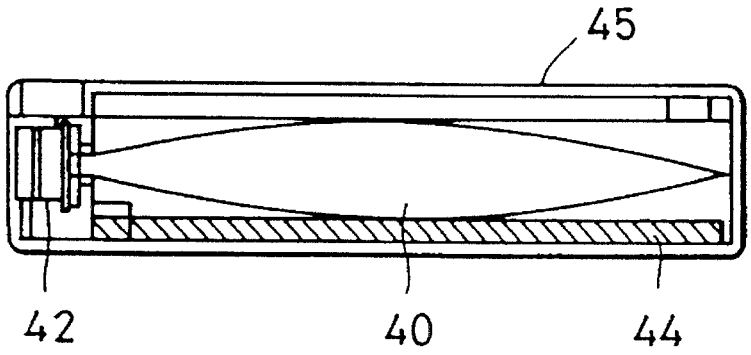
FIG. 5 is a vertical sectional view of an ink cartridge.

FIG. 5 illustrates an ink cartridge which contains an ink to be supplied therefrom to the printing head through an ink supplying member such as a tube. The ink cartridge has an ink container 40 which may be a sack filled with the ink. A rubber plug 42 is provided on an end of the ink container. The plug 42 is adapted to be pierced by a needle (not shown) so that the ink is supplied from the ink sack 40 to the printing head 65 through the needle. Numeral 44 denotes an absorption member for absorbing wasted ink. Preferably, the ink-contacting surface of the ink container is formed of a polyolefin, in particular polyethylene. The printing head and the ink cartridge may be provided and mounted separately as described or may be integrated to form a unit as shown in FIG. 6.

Figure 6:
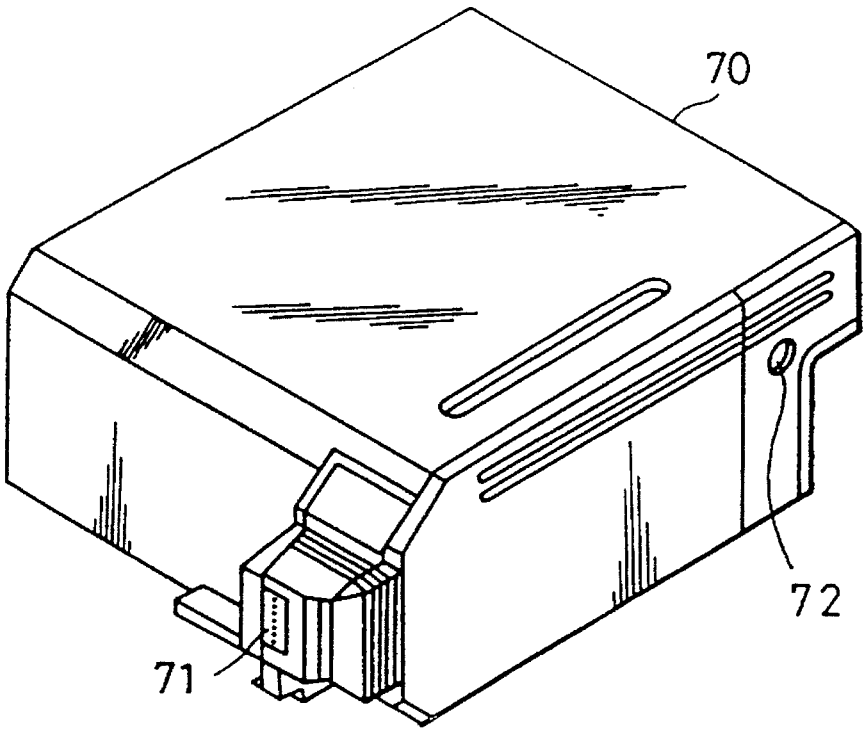
FIG. 6 is a perspective view of a print unit.

More specifically, referring to FIG. 6, a print unit 70 having an ink containing portion such as an ink absorption member from which an ink is supplied to a head portion 71 having a plurality of orifices so that the ink droplets are discharged from these orifices. Preferably, polyurethane is used as the material of the ink absorption member. Numeral 72 denotes a vent hole through which the interior of the print unit communicates with the ambient air. This print unit 70 can be used in place of the head shown in FIG. 4, and is detachably carried by the carriage 66.

EXAMPLES

The invention will be more fully described through illustration of Examples.

Example 1

An aqueous solution of kayacryl resin T-180 (water-soluble adhesion agent mainly composed of polyacryl) was applied by means of a doctor knife coater to the surface of a sheet of paper (80 μm thick, 70 g/m$^2$) which has been treated on its reverse side with a fluororesin. The paper sheet was then dried with air of 80° C. and then wound into a roll, whereby a backing sheet was prepared.

Then, a cotton roan treated with the aforementioned quarternary amine compound (3) (X=Cl) was superposed on the backing sheet and the laminate thus formed was made to pass through a nip between a pair of rubber rollers whereby a print medium was formed.

The print medium was cut into a sheet of A-4 size and subjected to multi-color printing using a commercially available ink jet color printer (BJC-820J produced by Canon Inc.). After printing, the cotton cloth was peeled off from the backing sheet, and was sufficiently rinsed with 0.1% aqueous solution of C.I. fluorescent brightener 84, followed by drying.

A color image of sufficiently high density was clearly printed on the cotton roan. In addition, there was no contamination in the non-print white area.

Example 2

An aqueous solution of kayacryl resin T-900 (water-soluble adhesion agent mainly composed of polyacryl) was applied through a silk screen to the surface of a Mylar film of 70 μm thickness, followed by drying with air of 80° C., whereby a backing sheet was prepared.

Then, a sheet of polyester Georgette, to which was applied a polyamide resin and dihydroxyethylene dimethylolurea, was superposed on the backing sheet and the laminate thus formed was passed through a nip between a pair of rubber rollers in order to form a print medium.

The print medium was then cut into a sheet of A-4 size and subjected to multi-color printing in the same manner as in Example 1. After printing, the Georgette was peeled off from the backing sheet, and the Georgette was sufficiently rinsed with 0.02% aqueous solution of C.I. fluorescent brightener 84, followed by drying.

A color image of sufficiently high density was clearly printed on the polyester Georgette. In addition, there was no contamination in the non-print white area.

Example 3

A print medium was prepared by superposing a sheet of paper with an adhesive agent prepared in the same manner as in Example 1 on a rayon cloth treated with the aforementioned compound (2) (X=Br) and causing the thus formed laminate to pass through the nip between a pair of rubber rollers to bond the paper and cloth together.

The print medium was then cut into a sheet of A-4 size and subjected to multi-color printing in the same manner as in Example 1. After printing, the rayon cloth was peeled off from the backing sheet, and the cloth was sufficiently rinsed with 0.05% aqueous solution of C.I. fluorescent brightener 40, followed by drying.

A color image of sufficiently high density was clearly printed on the rayon cloth. In addition, there was no contamination in the non-print white area.

Example 4

A mix-spun cloth of polyester and cotton (65/35) was padded (pick up 80%) with an aqueous solution containing 4 wt % of alumina sol 200 (produced by Nissan Chemical Industries, Ltd.) and 0.5 wt % of polyvinyl alcohol. After curing at 130° C., the cloth was bonded to a Mylar film coated with the adhesive agent used in Example 2, whereby a print medium was obtained.

The print medium was then cut into a sheet of A-4 size and subjected to multi-color printing in the same manner as in Example 1.

The cloth was peeled off from the backing sheet without delay after completion of the printing, and the cloth was sufficiently rinsed with 0.03% aqueous solution of C.I. fluorescent brightener 48, followed by drying.

A color image of sufficiently high density was uniformly and clearly printed on the polyester-cotton mix-spun cloth. In addition, there was no contamination in the non-print white area.

Example 5

A print medium was prepared by superposing a silk "habutae" cloth treated with the aforementioned compound (9) (X=Cl) on a backing sheet prepared in the same manner as in Example 1, and passing the thus formed laminate through the nip between a pair of rubber rollers.

The print medium was then cut into a sheet of A-4 size and subjected to multi-color printing in the same manner as in Example 1.

The cloth was peeled off from the backing sheet without delay after completion of the printing, and the cloth was sufficiently rinsed with 0.02% aqueous solution of C.I. fluorescent brightener 84, followed by drying.

A color image of sufficiently high density was clearly printed on the silk "habutae" cloth. In addition, there was no contamination in the non-print white area. Comparative Example 1

A print medium was prepared in the same manner as in Example 1 except that the C.I. fluorescent brightener 84 was not used.

The print medium was then cut into a sheet of A-4 size and subjected to multi-color printing in the same manner as in Example 1.

The cloth was peeled off from the backing sheet without delay after the completion of the printing and sufficiently rinsed with water, followed by drying.

The image printed on the cotton roan had sufficiently high density but the quality of the printed image was degraded due to contamination of the non-print white area, as well as by inferior edge sharpness of the image.

Comparative Example 2

A print medium was prepared in the same manner as in Example 5 except that the silk "habutae" cloth was not treated.

The print medium was then cut into a sheet of A-4 size and subjected to multi-color printing in the same manner as in Example 1.

After completion of the printing, the print medium was heated for 30 minutes at 80° C. and then sufficiently rinsed with water. The cloth was then peeled off from the backing sheet.

The color image formed on the silk "habutae" cloth had an impractically low image density.

Example 6

An aqueous solution containing kayacryl resin T-180 (water-soluble adhesion agent mainly composed of polyacryl) and C.I. fluorescent brightener 84 was applied by means of a doctor knife coater to the surface of a sheet of paper (80 μthick, 70 g/m$^2$) which has been treated at its reverse side with a fluororesin. The paper sheet was then dried with air of 80° C. and then wound into a roll, whereby a backing sheet was prepared. The amount of C.I. fluorescent brightener 84 was 1 g/m$^2$.

Then, a cotton roan treated with the aforementioned quarternary amine compound (1) (X=Cl) was superposed on the backing sheet and the laminate thus formed was passed through a nip between a pair of rubber rollers whereby a print medium was formed.

The print medium was then cut into a sheet of A-4 size and subjected to multi-color printing in the same manner as in Example 1. After the completion of printing, the print medium was sufficiently rinsed with water without delay and the cloth was peeled off from the backing sheet followed by drying, whereby a printed cloth was obtained.

A color image of sufficiently high density was clearly printed on the cotton roan. In addition, there was no contamination in the non-print white area.

Example 7

An aqueous solution containing kayacryl resin T-900 (water-soluble adhesion agent mainly composed of polyacryl) and C.I. fluorescent brightener 40 was applied through a silk screen to the surface of a Mylar film of 70 μm thickness, followed by drying with air of 80° C., whereby a backing sheet was obtained.

Then, a sheet of heat-treated polyester Georgette, to which was applied a mixture of polyamide resin and dihydroxyethylene dimethylolurea had been applied, was superposed on the backing sheet, and the laminate thus formed was passed through a nip between a pair of rubber rollers, whereby a print medium was formed.

The print medium was then cut into a sheet of A-4 size and subjected to multi-color printing in the same manner as in Example 1. After the completion of printing, the print medium was sufficiently rinsed with water, and the georgette was peeled off from the backing sheet and then dried, whereby a printed product was obtained.

A color image of sufficiently high density was clearly printed on the polyester Georgette. In addition, there was no contamination in the non-print white area.

Example 8

A print medium was prepared by superposing a backing sheet prepared in the same manner as in Example 6 on a rayon cloth treated with the aforementioned compound (2) (X=Cl) and causing the thus formed laminate to pass through the nip between a pair of rubber rollers so as to bond the paper and cloth together.

The print medium was then cut into a sheet of A-4 size and subjected to multi-color printing in the same manner as in Example 1. After the completion of printing, the print medium was sufficiently rinsed with water and the rayon cloth was peeled off from the backing sheet, followed by drying, whereby a printed product was obtained.

A color image of sufficiently high density was clearly printed on the rayon cloth. In addition, there was no contamination in the non-print white area.

Example 9

A backing sheet prepared in the same manner as in Example 6 was superposed to a silk "habutae" cloth treated with the aforementioned compound (8) (X=Br) and the laminate thus formed was passed through the nip between a pair of rubber rollers so as to be bonded together, whereby a print medium was obtained.

The print medium was then cut into a sheet of A-4 size and subjected to multi-color printing in the same manner as in Example 1. After the completion of printing, the print medium was sufficiently rinsed with water and the cloth was peeled off from the backing sheet, followed by drying, whereby a printed product was obtained.

A color image of sufficiently high density was clearly printed on the silk "habutae" cloth. In addition, there was no contamination in the non-print white area.

Example 10

A cotton roan was padded (pick up 80%) with an aqueous solution containing 3 wt % of alumina sol 200 (produced by Nissan Chemical Industries, Ltd.) and 0.5 wt % of polyvinyl alcohol. The cotton roan was then dried at 130° C. for 15 minutes.

The thus treated cotton roan was superposed to a backing sheet prepared in the same manner as in Example 6, and the laminate thus formed was passed through the nip between a pair of rollers so as to be bonded together, whereby a print medium was obtained.

The print medium was then cut into a sheet of A-4 size and subjected to multi-color printing in the same manner as in Example 1. After the completion of printing, the print medium was sufficiently rinsed with water and the cloth was peeled off from the backing sheet, followed by drying, whereby a printed product was obtained.

A color image of sufficiently high density was clearly printed on the cotton roan. In addition, there was no contamination in the non-print white area.

Example 11

A polyester georgette was padded (pick up 70%) with an aqueous solution containing 9 wt % of alumina sol 200 (produced by Nissan Chemical Industries, Ltd.) and 1.0 wt % of polyvinyl pyrrolidone. The polyester Georgette was then dried at 130° C. for 20 minutes.

The thus treated polyester Georgette was superposed to a backing sheet prepared in the same manner as in Example 7, and the laminate thus formed was passed through the nip between a pair of rollers so as to be bonded together, whereby a print medium was obtained.

The print medium was then cut into a sheet of A-4 size and subjected to multi-color printing in the same manner as in Example 1. After the completion of printing, the print medium was sufficiently rinsed with water and the cloth was peeled off from the backing sheet, followed by drying, whereby a printed product was obtained.

A color image of sufficiently high density was clearly printed on the polyester Georgette. In addition, there was no contamination in the non-print white area.

Example 12

A rayon cloth was padded (pick up 70%) with an aqueous solution containing 14 wt % of alumina sol 520 and 1.0 wt % of polyvinyl alcohol. The rayon cloth was then dried at 100° C. for 20 minutes.

The thus treated rayon cloth was superposed to a backing sheet prepared in the same manner as in Example 6, and the laminate thus formed was passed through the nip between a pair of rollers so as to be bonded together, whereby a print medium was obtained.

The print medium was then cut into a sheet of A-4 size and subjected to multi-color printing in the same manner as in Example 1. After the completion of printing, the print medium was sufficiently rinsed with water and the cloth was peeled off from the backing sheet, followed by drying, whereby a printed product was obtained.

A color image of sufficiently high density was clearly printed on the rayon cloth. In addition, there was no contamination in the non-print white area.

Example 13

A mix-spun cloth of polyester and cotton (65/35) was padded (pick up 65%) with the alumina-sol-containing solution used in Example 12 and, after curing by application of heat, bonded to a backing sheet used in Example 7, whereby a print medium was obtained.

The print medium was then cut into a sheet of A-4 size and subjected to multi-color printing in the same manner as in Example 1.

After the completion of printing, the print medium was dried with heated air of 80° C. for 1 minute, and the cloth was peeled off from the backing sheet followed by drying, whereby a printed product was obtained.

A color image of sufficiently high density was uniformly and clearly printed on the polyester-cotton mix-spun cloth. In addition, there was no contamination in the non-print white area.

Example 14

A print medium was formed by superposing a backing sheet used in Example 6 on a silk "habutae" cloth which has been padded (pick up 65%) with an alumina-sol-containing solution used in Example 10, and making them to pass through the nip of a rubber rollers so as to bond them together.

The print medium was then cut into a sheet of A-4 size and subjected to multi-color printing in the same manner as in Example 1.

After the completion of printing, the print medium was dried without delay, and the cloth was peeled off from the backing sheet followed by drying, whereby a printed product was obtained.

A color image of sufficiently high density was clearly printed on the silk "habutae" cloth. In addition, there was no contamination in the non-print white area.

As will be understood from the foregoing description, according to the invention, it is possible to effect printing on various types of cloths by an ink jet printing technique without requiring a change of the type of ink according to the kind of the cloth. In addition, a clear print image of sufficiently high coloring density is obtained even with commercially available ink jet printers for office or personal use. Furthermore, the present invention provides quite a simple process for printing on cloth sheets.

Although the present invention has been described through what is presently considered to be its preferred forms, it is to be understood that the described embodiments are only illustrative, and that the invention is intended to cover various equivalent changes and modifications included within the spirit and scope of the appended claims. The claims are to be accorded the broadest interpretation so as to encompass all such modifications, equivalent structures, and functions.

What is claimed is:

1. An ink jet printing method for effecting printing on a print medium by applying droplets of an ink to said print medium, said method comprising the steps of:

providing said print medium comprising a backing sheet coated with an adhesive agent, and a sheet of cloth containing a cationic substance, said cloth sheet being provided on said backing sheet;

applying said ink to said print medium;

rinsing said print medium with a rinsing liquid containing a cation blocking agent;

peeling said sheet of cloth from said backing sheet of said print medium after rinsing; and drying said sheet of cloth.

2. An ink jet printing method for effecting printing on a print medium by applying droplets of an ink to said print medium, said method comprising the steps of:

providing said print medium comprising a backing sheet coated with an adhesive agent, and a sheet of cloth containing a cationic substance, said cloth sheet being provided on said backing sheet;

applying said ink to said print medium;

rinsing said print medium with a rinsing liquid containing a cation blocking agent;

drying the rinsed print medium; and peeling said sheet of cloth from said backing sheet.

3. An ink jet printing method for effecting printing on a print medium by applying droplets of an ink to said print medium, said method comprising the steps of:

providing said print medium comprising a backing sheet coated with an adhesive agent, and a sheet of cloth containing a cationic substance, said cloth sheet being provided on said backing sheet;

applying said ink to said print medium;

peeling said sheet cloth from said backing sheet of the print medium;

rinsing said sheet of cloth with a rinsing liquid containing a cation blocking agent; and drying the rinsed sheet of cloth.

4. An ink jet printing method according to one of claims 1 to 3, wherein said cloth is selected from the group consisting of cotton, silk, rayon, acetate, nylon, polyester fiber cloth and a mix-spun cloth thereof.

5. An ink jet printing method according to one of claims 1 to 3, wherein said cation blocking agent is a water-soluble fluorescent brightener.

6. An ink jet printing method according to claim 5, in which the water-soluble fluorescent brighter is selected from the group consisting of C.I. Fluorescent Brighter 24, 84, 85, 90, 225, 351, C.I. Fluorescent Brighter 48, and C.I. Fluorescent Brighter 40 and 46.

7. An ink jet printing method according to one of claims 1 to 3, wherein said backing sheet is selected from the group consisting of paper, plastic, metal foil and a laminate of these.

8. An ink jet printing method according to one of claims 1 to 3, further comprising the step of heating said print medium after the ink applying step and in advance of the rinsing step.

9. An ink jet printing method according to one of claims 1 to 3, wherein the application of droplets of ink is conducted by using thermal energy.

10. An ink jet printing method according to one of claims 1 to 3, further including the step of providing the cationic substance to the cloth by an addition reaction of a reactive quaternary amine compound with fibers of the cloth.

11. An ink jet printing method according to one of claims 1 to 3, further including the step of providing the cationic substance to the cloth by applying cationic inorganic particles with a binder.

12. An ink jet printing method according to claim 11, wherein said cationic inorganic particles and binder further include a cross-linking agent.

13. An ink jet printing method according to claim 12, wherein said cationic inorganic particles include alumina, and said binder is selected from the group consisting of gum arabic, casein, glue, soybean protein, urea resin, melamine resin, polyallylamide, polyamide, polyethyleneimine, sodium polyacrylate, polyvinyl alcohol, gelatin, starch, sodium alginate, polyvinyl pyrrolidone, keratin, carboxymethylcellulose, methylcellulose, styrenebutadiene latex and styrene-maleic anhydride copolymer.

14. An ink jet printing method according to claim 12, wherein said cross-linking agent is selected from the group consisting of bifunctional epoxy compounds, bisacrylamide, ethylene dimethylolurea, propylene dimethylolurea, dihydroxyethylene dimethylolurea, and methylated dimethoxyethylene dimethylolurea.

15. An ink jet printing method according to one of claims 1 to 3, in which the cationic substance is contained in the cloth in an amount ranging from 0.01 to 30 wt. % based on the weight of the cloth.

16. An ink jet printing method according to one of claims 1 to 3, further including the step of providing the cationic substance to the cloth by applying an anionic dyeable polymer.

17. An ink jet printing method according to claim 16, wherein said anionic dyeable polymer is selected from the group consisting of gum arabic, casein, glue, soybean protein, urea resin, melamine resin, polyacrylamide, polyamide resin, polyurethane, polyethyleneimine, and polymers containing quaternary amino groups.

18. An ink jet printing method according to claim 16, wherein said anionic dyeable polymer further includes a cross-linking agent.

19. An ink jet printing method according to claim 18, wherein said cross-linking agent is selected from the group consisting of bifunctional epoxy compounds, bisacrylamide, ethylene dimethylolurea, propylene dimethylolurea, dihydroxyethylene dimethylolurea, and methylated dimethoxyethylene dimethylolurea.

20. An ink jet printing method for effecting on a print medium by applying droplets of ink to said print medium, comprising the steps of:

providing said print medium comprising a backing sheet having an adhesive agent and a cationic blocking agent, and a sheet of cloth containing a cationic substance, said cloth sheet being provided on said backing sheet;

applying said ink to said print medium;

rinsing said print medium with a liquid;

peeling said sheet of cloth from said backing sheet of said print medium; and drying said sheet of cloth.

21. An ink printing method according to claim 20, wherein said backing sheet is selected from the group consisting of paper, plastic, metal foil and a laminate of these.

22. An ink jet printing method according to claim 20, wherein said cloth is selected from the group consisting of cotton, silk, rayon, acetate, nylon, polyester fiber cloth and a mix-spun cloth thereof.

23. An ink jet printing method according to claim 20, further comprising the step of heating said print medium after the ink applying step, and in advance of the rinsing step.

24. An ink jet printing method according to claim 20, wherein the droplets of ink are formed by the action of thermal energy.

25. An ink jet printing method according to claim 20, wherein said cation blocking agent is a water-soluble fluorescent brightener.

26. An ink jet printing method according to claim 25, in which the water-soluble fluorescent brightener is selected from the group consisting of C.I. Fluoroscent Brightener 24, 84, 85, 90, 225, 351, C.I. Fluoroscent Brightener 48, and C.I. Fluorescent Brightener 40 and 46.

* * * * *

UNITED STATES PATENT AND TRADEMARK OFFICE

CERTIFICATE OF CORRECTION

PATENT NO. : 5,515,093

DATED : May 7, 1996

INVENTOR(S) : MASAHIRO HARUTA, ET AL.

It is certified that error appears in the above-indentified patent and that said Letters Patent is hereby corrected as shown below:

ON THE COVER PAGE:

Under "FOREIGN PATENT DOCUMENTS":

"JP-4-341885," should read --JP-A-4-341885,--.

IN THE DISCLOSURE:

COLUMN 3:

Line 14, "variety" should read --variety of--.

COLUMN 4:

Line 14, "quarternary" should read --quaternary--;

and

Line 22, "quarternary" should read --quaternary--.

COLUMN 5:

Line 54, "mμto" should read --mμ to--.

COLUMN 7:

Line 60, "step" should read --step,--.

COLUMN 9:

Line 51, "of" should read --to--.

UNITED STATES PATENT AND TRADEMARK OFFICE

CERTIFICATE OF CORRECTION

PATENT NO. : 5,515,093

DATED : May 7, 1996

INVENTOR(S) : MASAHIRO HARUTA, ET AL.

It is certified that error appears in the above-indentified patent and that said Letters Patent is hereby corrected as shown below:

COLUMN 10:

Line 7, "a" (second occurrence) should read --at--; and

Line 59, "quarternary" should read --quaternary--.

COLUMN 12:

Lines 22-23, "Comparative Example 1" should be a heading;

Line 60, "μthick" should read --μm thick--, and "at" should read --on--; and

Line 66, "quarternary" should read --quaternary--.

COLUMN 13:

Line 15, "T-900" should read --T-900--; and

Line 30, "georgette" should read --Georgette--.

COLUMN 14:

Line 32, "georgette" should read --Georgette--.

COLUMN 15:

Line 33, "of a" should read --of a pair of--.

COLUMN 16:

Line 31, "cloth" should read --of cloth--;

UNITED STATES PATENT AND TRADEMARK OFFICE

CERTIFICATE OF CORRECTION

PATENT NO. : 5,515,093

DATED : May 7, 1996

INVENTOR(S) : MASAHIRO HARUTA, ET AL.

It is certified that error appears in the above-indentified patent and that said Letters Patent is hereby corrected as shown below:

Line 45, "brighter" should read --brightener--;

Line 46, "Brighter 24," should read --Brightener 24,--;

Line 47, "Brighter 48," should read --Brightener 48,--; and

Line 48, "Brighter 40" should read --Brightener 40--.

COLUMN 18:

Line 3, "effecting" should read --effecting printing--;

Line 15, "ink" should read --ink jet--;

Line 35, "Fluoroscent" should read --Fluorescent--; and

Line 36, "Fluoroscent" should read --Fluorescent--.

Signed and Sealed this

Eighth Day of October, 1996

Bruce Lehman

*Attest:*

BRUCE LEHMAN

*Attesting Officer*

*Commissioner of Patents and Trademarks*

--